US006145348A

United States Patent [19]

Hardegree et al.

[11] Patent Number: 6,145,348

[45] Date of Patent: Nov. 14, 2000

[54] FABRIC AND PROCESS AND APPARATUS FOR PRODUCING SAME

[75] Inventors: Mike Hardegree; Martin Wildeman, both of Spartanburg; Brian Callaway, Moore, all of S.C.; John Broughton, Lancashire, United Kingdom

[73] Assignee: Tietex International, Inc., Spartanburg, S.C.

[21] Appl. No.: 09/136,785

[22] Filed: Aug. 19, 1998

[51] Int. Cl.[7] ..... P04B 1/14

[52] U.S. Cl. ..... 66/192; 66/195; 66/196; 28/158

[58] Field of Search ..... 28/108, 107, 112, 28/140, 143, 158, 165; 66/83, 85 R, 85 A, 169 R, 170, 190, 191, 192, 195, 196; 442/318, 319

[56] References Cited

U.S. PATENT DOCUMENTS

| | | | |
|---|---|---|---|
| 423,781 | 3/1890 | Landenberger | 66/196 |
| 1,816,416 | 7/1931 | Wilingham | 66/85 |
| 4,876,128 | 10/1989 | Zafiroglu . | |
| 4,891,957 | 1/1990 | Strack et al. . | |
| 5,187,952 | 2/1993 | Zafiroglu . | |
| 5,385,036 | 1/1995 | Spillant et al. | 66/87 |
| 5,651,847 | 7/1997 | Loeffler | 66/196 |
| 5,735,145 | 4/1998 | Pernick | 66/196 |
| 5,896,758 | 4/1999 | Rock et al. | 66/87 |

FOREIGN PATENT DOCUMENTS

| | | |
|---|---|---|
| 34655 | 1/1965 | Germany . |

*Primary Examiner*—Danny Worrell
*Attorney, Agent, or Firm*—Dority & Manning, P.A.

[57] ABSTRACT

A composite structure manufactured on a knit stitch machine and including a pair of preformed substrates joined together by a knitted yarn system while being separated by portions of the yarn system. Preferably the yarn is bulked after knitting and defines a plurality of supports between the substrates. The composite is produced by feeding the substrates through a knit stitch machine, on opposite sides of a spacer bar and developing the knit stitches of the yarn system through and about the substrates while located on opposite sides of the spacer bar. After the composite is produced it preferably is subjected to heat to cause yarn of the yarn system to bulk and form supports between the substrates. The composites may be enclosed in sealed polymeric envelopes to form a cushioning pad, or may be used for filtration, insulation or other uses. The process of producing the composite and the spacer bar are also disclosed and claimed.

13 Claims, 4 Drawing Sheets

FABRIC AND PROCESS AND APPARATUS FOR PRODUCING SAME

Background of the Invention

The present invention relates to an improved composite structure that finds use in varied environs, exemplified by insulation, (thermal and sound), wall and window treatments, cushion pads, and the like, as well as apparatus and method for producing same.

Since the evolution of the knit stitch process, numerous and varied fabrics have been produced on knit stitch machines sometimes referred to as stitch bonding machines, as well as various warp knitting machines. In like fashion, fabrics have been produced heretofore on such types of machines where varied elements have been utilized in the construction of the fabric. An example of such is plural layers of webs or plural yarns atop various webs to afford certain structural and/or aesthetic qualities to the ultimate product formed by knit stitches thereacross. Additionally, materials other than fibers, webs or fabrics have been used exemplified by metal foils, polymeric films and the like. Likewise, on certain stitch bonding machines such as a Maliwatt machine, a fleece or web of fibers has been fed through the throat of the machine where the web is knitted across its width to impart additional or initial integrity to the fleece or web.

In the examples set forth above, the primary thrust of the exercise has been simply to provide an alternative or modification to conventional knitting to provide a fabric structure for various specific functional and/or aesthetic purposes. The fabric structures produced have included one or more layers or substrates held together in a juxtaposed orientation by a thread system of knit stitches.

According to the teachings of the present invention, however, plural preformed substrates are included, but which are bound together while being held apart to achieve a different level of functionality for these general types of goods. The only knitted structure of which applicants are aware that is even close to structures according to the present invention are certain fabrics produced on raschal machines, referred to as "spacer fabrics." Spacer fabrics are formed by the knitting of two layers of knit structure and the spacing part of the knit structures by portions of the knitting thread. Not only is such a fabric and system of production limited to unitary knitted structures, the process by which they are produced is very slow. On the other hand, a composite according to the present invention is limited only by materials capable of being pierced during the knit stitch process, and the machines on which the composites are produced are capable of higher production rates than the raschal machines. Hence, composites according to the present invention are vastly different from the raschal "spacer fabrics."

While as noted above, widely varied fabrics and/or fabric constructions or fabric composites have been heretofore produced, composites according to the present invention have not previously been produced, nor are the apparatus or process for producing same taught by or obvious in view of the prior art.

SUMMARY OF THE INVENTION

It is an object of the present invention to provide an improved composite structure.

Another object of the present invention is to provide an improved fabric composite which has enhanced functional and/or aesthetic qualities.

Still, another object of the present invention is to provide an improved composite having two same or different preformed layers that are united by an independent thread system but maintained in spaced relation from each other, defining open passageways therebetween.

Yet another object of the present invention is to provide a textile composite having first and second preformed fibrous layers bound together by a knitted thread system while at the same time being maintained spaced apart by the thread system.

Still further, another object of the present invention is to provide an improved composite including two layers of preformed material that are bound together by a knitted thread system, a portion of which thread system spaces the layers apart from each other.

Another object of the present invention is to provide a textile composite which includes a pair of textile substrates which are bound together by an independent knitted thread system, a portion of which after being subjected to heat treatment bulks to hold the textile substrates apart, defining voids therebetween.

Still another object of the present invention is to provide a process for producing an improved composite having first and second preformed layers secured together in a spaced apart relationship, defining voids therebetween.

Another object of the present invention is to provide an improved process for producing a composite which includes first and second preformed substrates joined by a thread system while being held apart in spaced relation by a portion of the system, defining space therebetween.

Yet another object of the present invention is to provide an improved process for producing a textile composite including two layers of preformed textile material that are secured together by a knitted thread system and which are held apart by a portion of the thread system located therebetween.

Another object of the present invention is to provide an improved apparatus for producing a composite including first and second layers of material that are stitched together by an independent knitting thread system while being held apart by a portion of the thread system in spaced relation.

Yet another object of the present invention is to provide an improved apparatus for producing a knit stitch fabric having first and second preformed layers of material capable of being stitched through on a knit stitch machine where the layers are bonded together by a knitted thread system while being maintained spatially separate from each other by a portion of the thread system which has been bulked.

Generally speaking, the improved composite according to the present invention comprises a pair of preformed substrates and a yarn system interconnected with both of said substrates, bonding said substrates together, portions of said yarns of said yarn system holding said substrates apart to define voids therebetween.

More specifically, the improved composite according to the present invention includes a pair of preformed substrates that may be the same or different materials, thicknesses, constructions or the like, and which are united by an independent thread system to form a unified structure while at the same time portions of the yarns or threads of the thread system provide barriers between the two substrates which hold the substrates apart and define passageways between the substrates. In a most preferred arrangement, each of the substrates is a non-woven textile substrate while the thread system is a thread system which has been knitted about the two substrates, and with a portion of the knitting thread being located between the spaced apart substrates. The knitting thread connects the substrates together and serves to form a stable structure. Preferably, after the composite comes off the production machine, it is subjected to heat adequate to bulk the knitting yarn, forming pillows or tufts of yarn between the substrates to hold same apart.

According to a most preferred arrangement of the present invention, a pair of non-woven fibrous substrates are fed to a knit stitching machine, on opposite sides of a unique spacer bar. As the substrates pass through the throat of the knit stitch machine, knit stitches are developed through and about both substrates to define an independent knitted thread system. An independent thread system is one that is separate from the substrates. The knitting needles pass through slots or openings in the spacer plate whereby the composite produced on the machine has the spaced apart substrates as it comes off the machine with portions or lengths of the knitting threads therebetween. In a most preferred arrangement, the knitting thread is bulkable such that when the composite is subjected to heat, the thread bulks with the thread lengths between the substrates forming bulked pillars or supports between the two substrates, holding them apart. Moreover, the stitches appear in rows along the length of the substrates such that open channels are provided lengthwise of the substrates of the composite.

Generally speaking, the process according to the present invention comprises the steps of feeding a pair of preformed substrates on opposite sides of a spacer element and developing knit stitches through and about the separated substrates to form a composite therefrom. While any binding arrangement is suitable so long as the portions of the thread or yarn between the substrates binds the substrates together and also holds the substrates apart, stitching is preferred that will provide yarn between the spaced apart preformed substrates and continue to hold same apart. In a most preferred arrangement, the stitching yarn is a textured yarn that will bulk upon the application of heat, though nontextured yarns could also be used. Subjecting the composite to heat adequate to bulk the yarn located between the independent substrates forms a plurality of individual pillows or supports between the substrates that holds the substrates apart and defines channeled spaces thereamong.

Generally speaking, apparatus according to the present invention comprises a machine for producing knit stitches across the width of a material passing therethrough, and comprising a support frame; said support frame defining a throat area through which materials to be stitched are passed; a plurality of knitting elements on opposite sides of said throat area and being cooperative to generate knit stitches through materials passing through said throat; and a spacer bar located in said throat area, said spacer bar being sized and located to permit said first substrate to pass thereabove and a second substrate to pass therebelow, said spacer bar further defining adjacent a forward end a plurality of notches, slots or openings for passage of knitting needles therethrough.

More specifically, the overall machine is of the same general type found in knit stitching and provides a new combination when a spacer bar according to the present invention is added thereto. The spacer bar is secured to reside at least in part within the throat of the knit stitch machine where the knit stitches are formed and defines an opening for each needle being utilized to develop knit stitches about the substrates passing through the machine. The spacer bar generally defines the resultant space between the substrates and thus the finished composite. Dimensions of the notches defined on a forward end of the spacer bar are such that a knitting needle will pass therethrough while at the same time not being large enough in width (across machine direction) that when the stitching yarn is pulled taut, the adjacent substrate portion would be pulled out of general planar alignment and into the defined notches.

DERAILED DESCRIPTION OF PREFERRED EMBODIMENTS

Making reference to the Figures, preferred embodiments of the present invention will now be described in detail.

Figure 1:
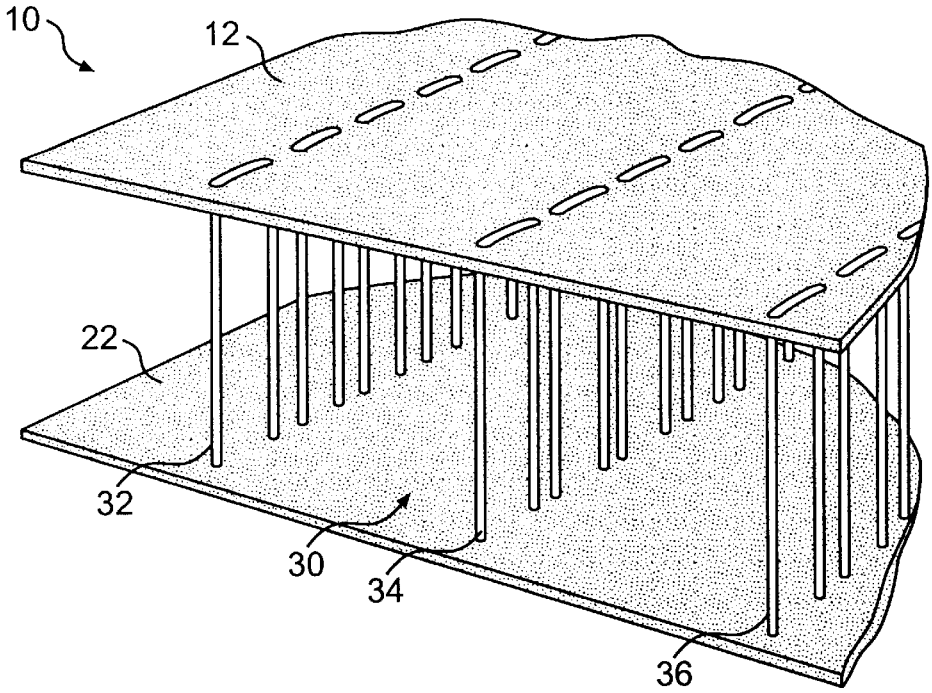
FIG. 1 is an isometric view of a version of an exemplary composite produced according to the present invention as it comes off of the machine.
Figure 2:
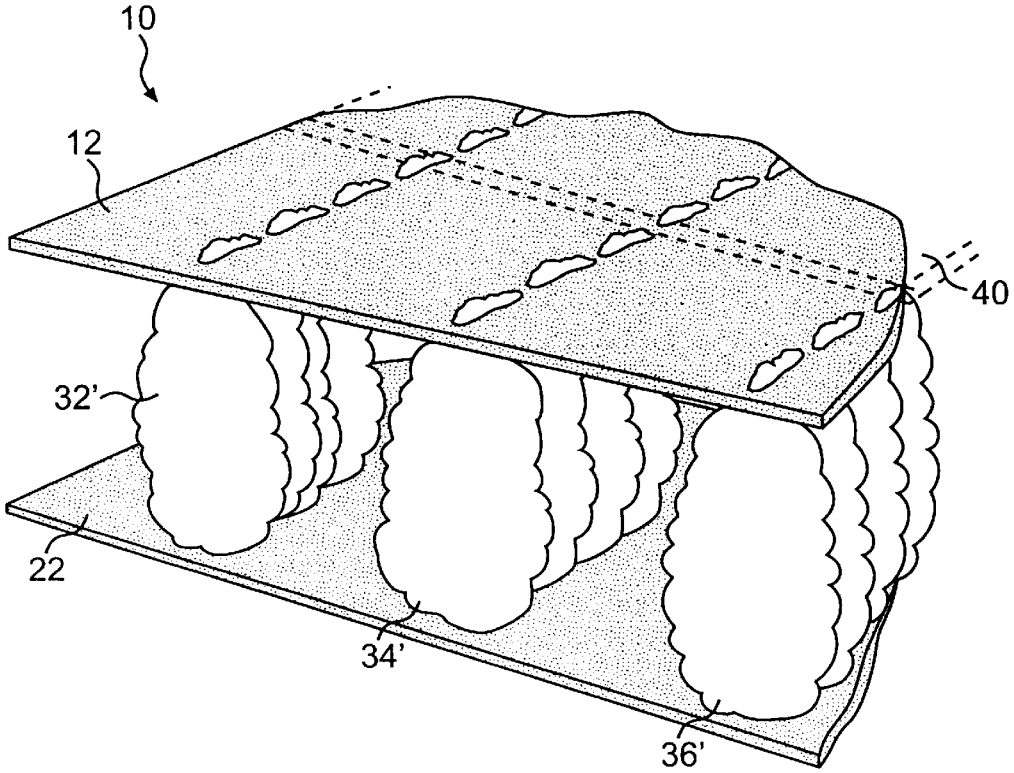
FIG. 2 is an isometric view of the exemplary composite of FIG. 1 after being subjected to heat such that portions of the yarns of the thread system have bulked to hold the substrates apart.

Looking to FIG. 1, a composite generally indicated as 10 is shown having a first substrate 12, a second substrate 22 and a system of knitting yarns generally indicated as 30 uniting substrates 12 and 22 while holding same apart. FIG. 1 illustrates the composite immediately after formation in a preferred arrangement and prior to any heat treatment. FIG. 2, on the other hand, generally illustrates a portion of a composite as shown in FIG. 1, but following heat treatment where the individual yarn sections 32', 34', and 36' have been heated adequately to cause the yarn to bulk. Also other portions of yarns 32', 34', and 36' have also bulked as can be seen atop substrate 12. Pillars 32', 34', and 36' thus have been formed and define individual support posts that hold substrates 12 and 22 apart in spaced relation. Hence, the independent system of threads or yarns both binds the substrates together while holding same apart by a predetermined amount. As can further be seen in FIG. 2, a plurality of such rows of yarn sections 32', 34', and 36' define channels therebetween, along the length of composite 10 in which a fluid may pass or be retained depending on ultimate use of the composite. Knitting yarns can be any yarn that will perform the desired spacing though a textured, bulkable yarn is preferred.

Composites 10 find use in a number of different areas. For example, if composite 10 is intended for use as, or as a part of a cushion or cushioning pad, a cover 40 (partially shown in phantom in FIG. 2) may be placed around composite 10, and closed or sealed to confine composite 10 within an envelope formed by the cover. In such case, air or other fluid within the cavities, channels or the like defined by the rows of bulked yarns is maintained. Also, in a preferred situation a composite 10 within an envelope is bonded to the inside of the top and bottom portions of the film or other product making up the envelope which provides a uniform product and avoids ballooning of walls of the envelope. Hence, when composite 10 is secured to inside walls of an envelope that receives the composite, a compact and uniform cushioning pad is provided.

As to the composites according to the present invention, first and second preformed substrates 12 and 22 respectively may take any form that is desired for the particular end use of the composite so long as the substrate can be pierced by the knitting needles with the subsequent generation of knit stitches thereabout. Preferably, and most often, substrates 12 and 22 are each textile webs such as a non-woven web exemplified by Reemay which is a polyester non-woven web. Substrates 12 and 22, however, could be, by way of example and without limitation, films, polymer sheets, metal foils, woven fabrics, knitted fabrics, or other versions of non-wovens or fleeces. Furthermore, there is no necessity for the two substrates to be the same. Again, depending upon the intended use of the composite, and by way of example only, one of the substrates could be a decorative fabric, such as might be provided for a window treatment, while the other substrate could be a nondecorative liner or insulating liner. The decorative substrate could be disposed to be viewed as a drape while the opposite substrate could be a nondecorative substrate provided for insulation or lining.

Figure 3:
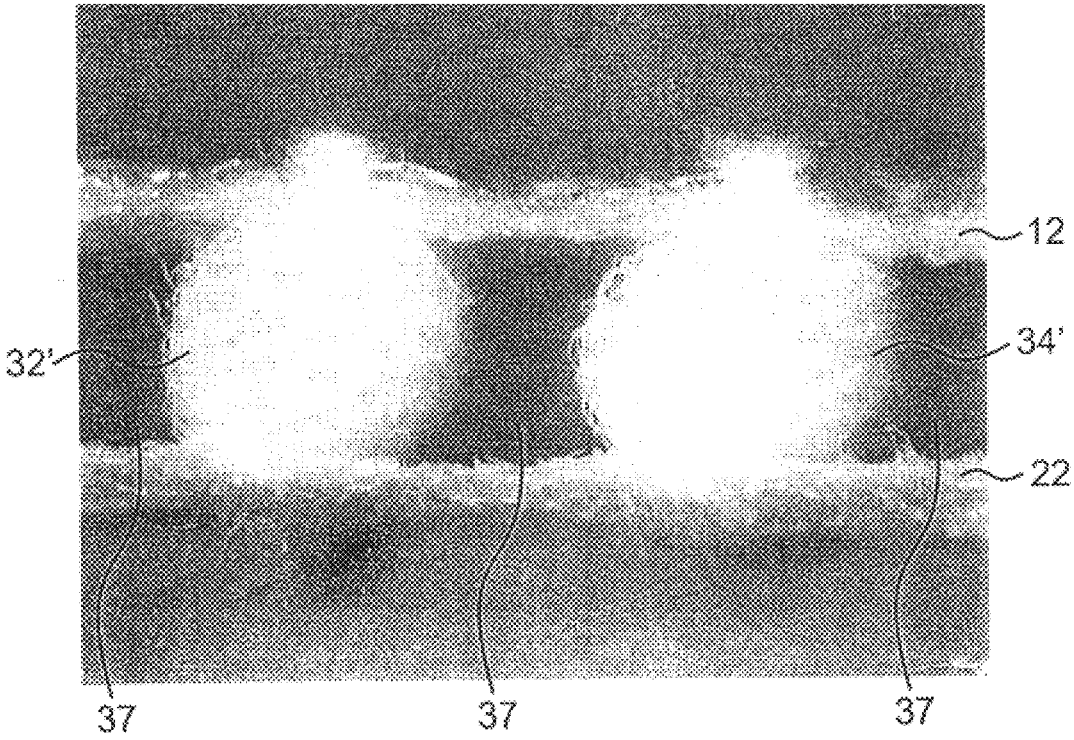
FIG. 3 is a side cross-sectional view of a photomicrograph of an actual composite produced according to the present invention.

Likewise, the air spaces defined between the substrates add an insulating quality to the composite. Consequently, lighter substrates could be used for window treatments, for example while possibly retaining an acceptable sound and/or thermal insulating capability.

similarly, in industrial environs, as noted above, composites according to the present invention may be employed for filtration. Reference is made to FIG. 3, wherein it can be seen that the bulked pillows, 32', 34' include fibrous protrusions. By selecting a proper yarn, a proper knit stitch, proper separation of stitches or the like, a plurality of pillows may be located across a width of a composite according to the present invention such that the protruding fibrous portions will serve as collectors for fluid borne contaminants, thus providing a fluid filter or filter media. A number of layers of composites could be provided to fill a fluid passageway for filtering contaminants from fluids passing therethrough. Composites may be engineered to permit passage of fluid along the passageways between the substrates defined by the composite, or conversely through one or both of the substrates and the space therebetween.

A microphotograph of an actual composite according to the present invention is shown in FIG. 3 after the composite has been subjected to heat treatment. As can be seen, a first substrate 12 forms a top of the composite while a bottom substrate 22 forms a bottom of the composite and with pillars or supports 32', 34' shown therebetween. As can be seen, a plurality of channels, open spaces, cavities, passageways or the like 37 is present between the various bulked yarn pillars 32', 34', etc. and extends along the composite which, when produced was in the machine direction.

As shown in phantom, and symbolically in FIG. 2, a cover 40 may be provided about all or a portion of composite 10 according to the present invention to afford certain characteristics thereto. Cover 40 can take many forms to afford aesthetic or functional qualities to composite 10. Just by way of example, and without limitation, cover 40 could be a decorative fabric, a film, or other structure and may be adhesively or otherwise secured to substrate 12 as shown. Cover 40, as noted above could be provided across all or a portion of one or both of the substrates, or located completely around the composite as an envelope. Again, by way of example, cover 40 could be a film that is impermeable to air which, when enclosing the composite, would preclude the passage of air or other fluid through the portion of the composite to which the impermeable film is secured. If provided as an envelope around a composite of a particular shape, a cushion or pad may be provided. Entrapped air, or other fluid, within the cavities 37 between and around the various pillars that hold the first and second substrates apart will afford a cushioning effect, and securement of the composites to the underside of the walls of the envelope will avoid ballooning of the envelope away from the substrates. Obviously, the composite 10, according to the present invention, may be used without a cover. Without a cover 40 in place, however, force applied to either of the substrates 12, 22 will cause collapse of the composite once the force overcomes the resistance of the pillars or supports, expelling air from the cavities 37 located between and among the pillar structures. When, however, a cover 40 that is impermeable to air, as noted above, is placed about a composite 10 and sealed, the air is held within the cavities and adds additional resistance to collapse though by virtue of its compressibility, adds a cushioning effect. Such a product for example could be employed in footwear, seat cushions, upholstery, sport pads, and, in fact, anywhere that a cushioning effect is desired.

Figure 4:
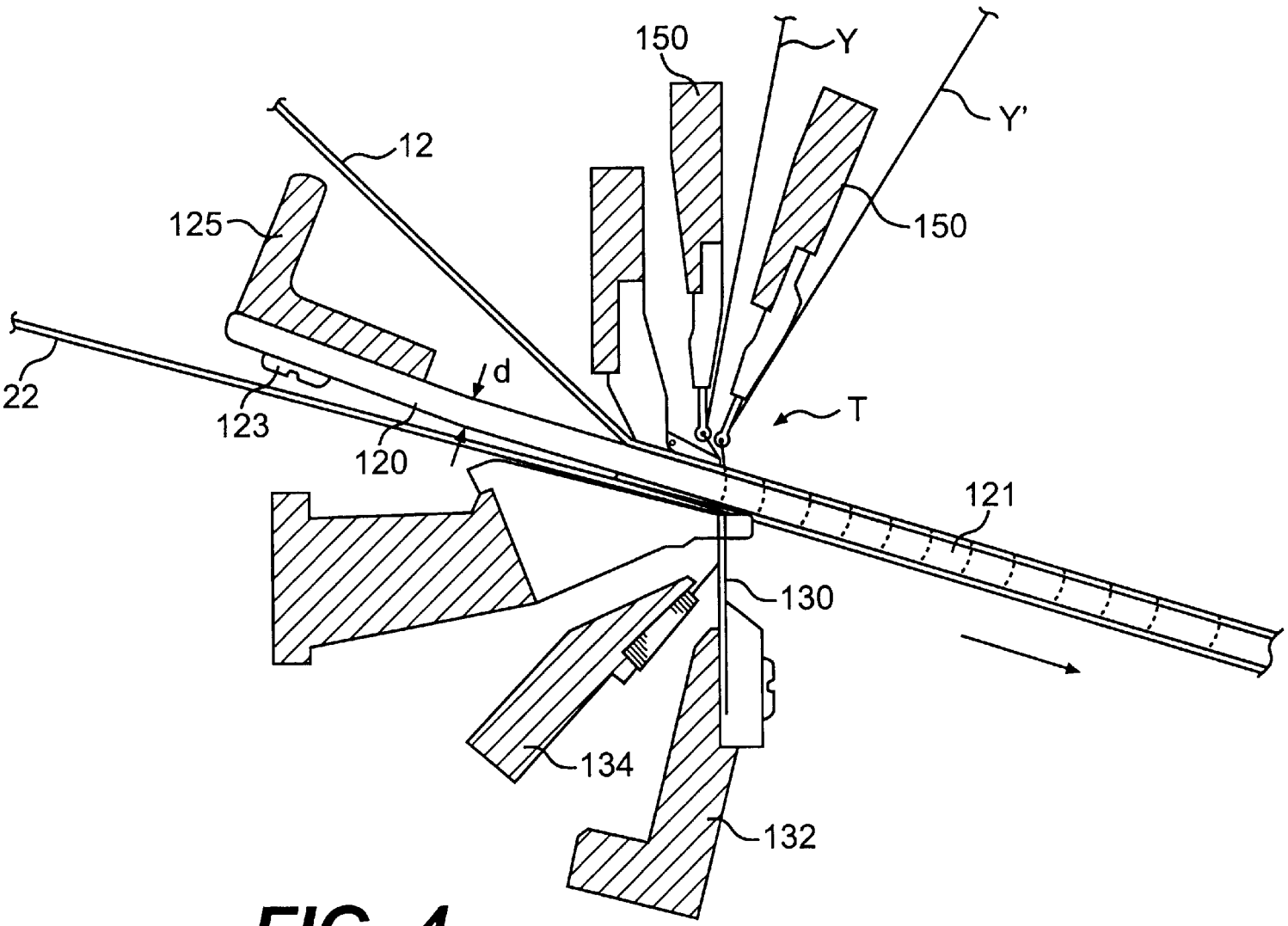
FIG. 4 is a schematic view of a portion of a knit stitch machine, in relevant part, to illustrate production of a composite according to the present invention.
Figure 5:
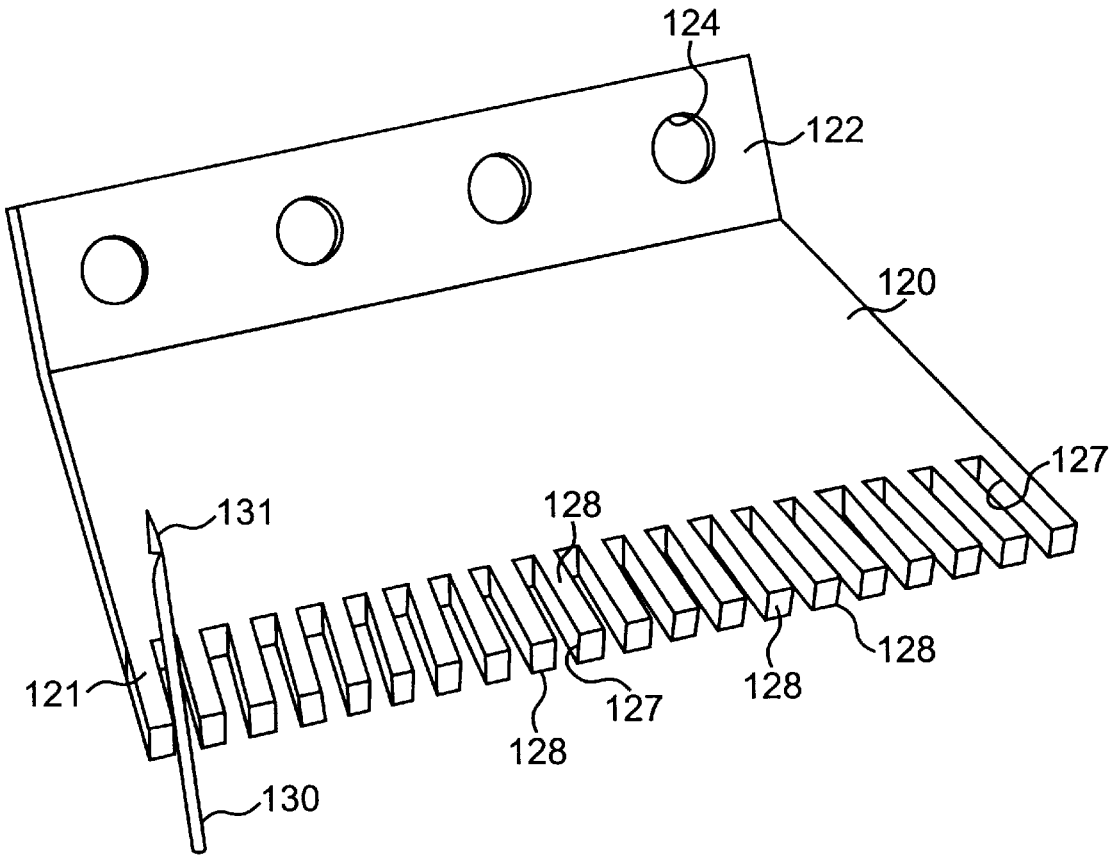
FIG. 5 is an isometric view of a spacer bar according to the present invention for the production of composite structures.

FIG. 4 illustrates a portion of a knit stitch machine, in relevant part to the present invention, for manufacture of composites 10. FIG. 4 is a side elevational view of the throat portion of the knit stitch machine where the thread system is manipulated to generate knit stitches. The throat area generally indicated as T is shown having a spacer bar 120 located therein. Spacer bar 120 is located in advance of throat T and preferably extends therethrough. Spacer bar 120 is secured to an appropriate support 125 and preferably has a thickness of greater than about 1 millimeter, particularly greater than about 10 millimeters and in some applications greater than about 25 millimeters. At a forward end 121 (downstream of throat T), as is best shown in FIG. 5, a plurality of notches 127 are defined and extend across the width of bar 120. Obviously spacer bar 120 can be produced in sections that are secured across the width of the knit stitch machine where the composite will be produced or provided as a continuous plate. As also shown in FIG. 4, spacer bar 120 is secured to an underside of support 125 by bolts or the like 123, though as indicated in FIG. 5, a rear end of spacer bar 120 may form a flange 122 defining a plurality of openings 124 therein for receipt of bolts or other fasteners. The means of attachment of spacer bar 122, the knit stitch machine, is not crucial to operation of the present invention. However, notches 127 in bar 120 are important as will be described hereinafter.

As further illustrated in FIG. 4, a plurality of needles 130 are located below throat T and are secured to a conventional support mechanism 132. Support 132 works in conjunction with a slide mechanism 134 to move up and down across throat T, penetrating the substrates or other material located in throat T. Needles 130 engage a yarn Y being held by a guide 150 above throat T and pulls same back through the materials within throat T to form a series of loops and thus knit stitches about the materials in the machine direction as the substrates move through throat T. As shown, a pair of yarns Y are each fed to the throat area through yarn guide mechanisms 150 and thus presented to needles 130 as described. While other portions of the knit stitch machine as shown in FIG. 4 are not described, they are conventional on knit stitch machines and are well known to those skilled in the art. Also, as known to those skilled in the art, operation of the machine varies with the particular knit stitch being produced, e.g. chain, tricot, etc. Also single or double bar arrangements are acceptable.

Notches 127 in spacer bar 120 are sized to receive needles 130 therethrough as is illustrated in FIG. 5. Notches 127 are defined by spaced apart webs 128 at an outer end 121 of bar 120 which extend inwardly for a pre-determined distance. It should be noted that notches 127 should be sized to permit the smooth passage of needles 130 therethrough while at the same time having a width dimension between webs 128 that will not permit a substrate located above or below plate 120 to be pulled partially into a notch 127 by the tension of threads Y during the knitting operation as will be defined more particularly hereinafter.

Referring to the Figures, the process for producing a composite according to the present invention will now be described.

A first substrate 12 is fed from a supply of same on the knit stitch machine (not shown) to pass through the throat T atop spacer plate 120. Bottom substrate 22 is fed from a supply of same (not shown) beneath spacer plate through throat T. As the two substrates are being fed through the machine, preferably at synchronous speeds, though variable speed arrangements are acceptable if desired for a particular composite, and which are well within the purview of one skilled in the art, needles 130 across the width of throat T are cammed upwardly through substrate 22 notches 127 of plate 120 and top substrate 12 where the latch 131 of needles 130 receives yarn Y, from yarn guides 150 and retracts, pulling yarns Y through substrate 12 and substrate 22 while spacer plate 120 holds substrates 12 and 22 apart. Then as substrates 12 and 22 move forward through the machine by the appropriate stitch length, needles 130 again move upwardly through substrate 22 notches 127 and substrate 12 and engage yarns Y repeating the process. Obviously as is known to those of ordinary skill in the art, loops are formed depending upon the particular knit stitch employed and new sections of yarns Y are pulled through the loops to create the knitting stitches. As illustrated in FIGS. 1, 2 and 3, a chain stitch is being utilized, though obviously any knit stitch may be utilized in accordance with the present invention. In this regard, obviously, when a knit stitch such as a tricot is employed a lateral oscillatory movement is provided to the yarn guides for achieving same according to the intended pattern.

During the knitting operation, yarns Y are pulled taut against the substrates 12 and 22 which tends to pull substrates 12 and 22 together except for the presence of spacer plate 120 therebetween. In this regard, as noted above, the width of notches 127 should be large enough to permit smooth passage of the knitting needles therethrough while at the same time, not permitting adjacent portions of either of the substrates to be pulled into the notches adequately to create a problem. As now knitted, substrates 12, 22 move further through the machine. The substrates move away from spacer plate 120 and are collected on an appropriate take up roll or the like (not shown). As can be seen from FIGS. 4 and 5, spacer plate 120 has a finite length where once the stitches are produced and the composite of the type as illustrated in FIG. 1 is present, it moves away from support plate 120 to the take up. In those instances, where tension on the composite during take up per se would cause undue crushing of the composite, the composite could be fed through a heating tunnel or zone (not shown) before take up which would cause bulking of yarns 32, 34, 36, etc after which the heat treated composite can then be taken up on a roll and with adequate support being provided between the two substrates to preclude excessive compression of same.

The process and products of the present invention may be better understood by reference to the following examples:

EXAMPLE 1

A composite was produced on a Liba Warp knit machine with a spacer plate having a thickness of about 5.5 millimeters. Both the top and bottom substrates were Reemay, a non-woven polyester web, while the stitch yarn was 140 denier two ply 68 filament textured nylon. A chain stitch was utilized, with the produced composite thereafter heat set on a tenter frame at a temperature of approximately 400 degrees Fahrenheit, 15 second dwell, which caused the stitching yarns located between the substrates to bulk similarly to that shown in FIGS. 2 and 3. The produced composite was then cut to size for a polyurethane envelope and inserted, after which edges of the envelope were sealed. The pad then became a support pad with air entrapped to give a pillar effect when force is applied transversely thereto.

EXAMPLE 2

Upper and lower substrates of Reemay were utilized with the stitch yarn being a textured polyester instead of nylon. After the composite was produced, it was passed through a tenter frame at a temperature of approximately 400 degrees Fahrenheit which caused the textured polyester between the substrates to bulk and afford support to keep substrates separated.

The above description sets forth preferred embodiments of the present invention, but should not be considered to be limiting. Instead, breadth of the present invention should be determined by the claims appended hereto. Also, it is intended that the above parameters of the invention are not intended for use only as specifically shown and described, but may be interchanged with other parameters of the invention as generally set forth.

What is claimed:

1. A textile composite structure comprising:

a first nonwoven textile substrate, a second nonwoven textile substrate, and a yarn system of texturized yarns forming knit stitches through and about said substrates, portions of said yarns transverse to a plane through a major dimension of said substrates holding said substrates apart from each other; and a sealed polymeric envelope received around said substrate, said envelope being impervious to passage of air.

2. A composite as defined in claim 1 wherein said substrates are secured to an inside of said envelope.

3. A composite as defined in claim 2 wherein said substrates and said envelope have a predetermined shape.

4. A textile composite structure comprising a first nonwoven textile substrate, and a yarn system of texturized yarns forming knit stitches through and about said substrates, portions of said yarns transverse to a plane through a major dimension of said substrates holding said substrates apart from each other, wherein said yarns are bulked.

5. A composite as defined in claim 1, wherein said yarns are bulked.

6. A composite structure comprising a pair of preformed substrates, and a yarn system interconnected with both of said substrates, portions of yarns of said yarn system holding said substrates apart to define space therebetween, wherein said yarns holding said substrates apart are bulked.

7. A composite as defined in claim 1 wherein said substrates are woven fabric.

8. A textile composite as defined in claim 1 wherein said substrates are knitted fabric.

9. A textile composite as defined in claim 1 wherein said substrates are non-woven fabric.

10. A composite as defined in claim 8 wherein said yarn system is knitted to provide a plurality of rows of yarns transverse to a plane through a major dimension of said substrates, thus providing a plurality of rows of bulked supports between said substrates.

11. A composite as defined in claim 4 wherein said yarns in said yarn system are polyester.

12. A composite as defined in claim 4 wherein said substrates are both polyester nonwovens.

13. A composite as defined in claim 4 wherein one of said substrates is a decorative fabric.

* * * * *